US006947011B2

(12) United States Patent
Kukita et al.

(10) Patent No.: US 6,947,011 B2
(45) Date of Patent: Sep. 20, 2005

(54) CONNECTOR UNIT

(75) Inventors: Hiroaki Kukita, Kanagawa (JP); Hiroyuki Taguchi, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/809,686

(22) Filed: Mar. 26, 2004

(65) Prior Publication Data

US 2004/0252073 A1 Dec. 16, 2004

(30) Foreign Application Priority Data

Mar. 28, 2003 (JP) ..... 2003-092360

(51) Int. Cl.[7] ..... H01Q 1/50

(52) U.S. Cl. ..... 343/906; 343/702; 439/188; 455/277.1

(58) Field of Search ..... 343/702, 906; 439/188, 944; 455/90.3, 277.1

(56) References Cited

U.S. PATENT DOCUMENTS

| | | | | |
|---|---|---|---|---|
| 5,108,300 A | | 4/1992 | Weber | |
| 5,365,027 A | * | 11/1994 | Marvet et al. | 200/16 D |
| 5,741,146 A | | 4/1998 | Henry et al. | |
| 5,835,071 A | * | 11/1998 | Phelps | 343/906 |
| 5,989,046 A | | 11/1999 | Togashi | |
| 6,171,123 B1 | | 1/2001 | Chang | |
| 6,213,801 B1 | | 4/2001 | Tayloe et al. | |
| 6,224,407 B1 | * | 5/2001 | Duquerroy et al. | 439/188 |
| 6,473,045 B1 | * | 10/2002 | Duquerroy et al. | 343/702 |

FOREIGN PATENT DOCUMENTS

| | | |
|---|---|---|
| EP | 0 869 584 | 10/1998 |
| GB | 2 263 590 A | 7/1993 |
| JP | 2000-174527 A | 6/2000 |
| JP | 2001-143032 A | 5/2001 |
| JP | 2001-285119 A | 10/2001 |
| JP | 2002-092576 A | 3/2002 |
| JP | 2002-099352 A | 4/2002 |
| JP | 2003-037538 A | 2/2003 |

OTHER PUBLICATIONS

European Search Report.

* cited by examiner

*Primary Examiner*—Tan Ho
(74) *Attorney, Agent, or Firm*—Rader, Fishman & Grauer PLLC

(57) ABSTRACT

A connector unit for a high frequency radio apparatus having a housing, a first internal antenna, a radio unit, and an external antenna. The connector unit includes: a printed board having a first microstrip line and a second microstrip line; a fixed contact provided on the printed board; a movable contact provided on the printed board; and a socket. In the connector unit, when the external antenna is inserted into the socket, a distal end of the external antenna enters between the movable contact and fixed contact, and abuts on and presses the movable contact to separate it from the fixed contact. In contrast, when the external antenna is drawn from the socket, the movable contact abuts on the fixed contact. Thus, an antenna switching mechanism can be realized with a simple configuration. The first internal antenna and external antenna can be used in an optimum condition.

9 Claims, 10 Drawing Sheets

CONNECTOR UNIT

CROSS-REFERENCE TO RELATED APPLICATIONS

This application is based upon and claims the benefit of priority from the prior Japanese Patent Application No. 2003-092360 filed on Mar. 28, in 2003, the entire contents of which is incorporated herein by reference.

FIELD OF THE INVENTION

The present invention relates to a connector unit. More specifically, it relates to a connector unit for wireless LANs (Local Area Network), which are provided in, for example, notebook-sized personal computers and desktop personal computers.

BACKGROUND OF THE INVENTION

There have been conventionally known wired LANs as a form of networks, whereas in recent years wireless LANs have been in common use instead of wired LANs. The wireless LANs are used, for example, at Hotspots on streets, at offices, and homes.

At a Hotspot, users can access the Internet freely just by connecting a wireless LAN adapter to a notebook-sized personal computer or using PDA (Personal Digital Asistant) without becoming a member of a certain service or installing a dedicated software.

Also, at offices and homes, users can connect notebook-sized personal computers, hereinafter referred to as PCs, to broadband routers by wireless everywhere to access the Internet freely just by connecting wireless LAN adapters to their PCs.

The notebook-sized PCs and PDAs each incorporate an antenna for sending and receiving radio waves. Further, as wireless LAN standards, there are IEEE 802.11b according to IEEE (Institute of Electrical and Electronic Engineers) as well as Bluetooth for short-range radio communication, for example.

A notebook-sized PC may include a plurality of antennas in which a diversity system is adopted for the purpose of increasing a receiving efficiency (see JP-A-2003-37538, for example). The notebook-sized PC has two antennas for receiving through the diversity system and an antenna for receiving through a radio communication system different from the former antennas, which are effectively disposed in a limited space inside the case. Moreover, these internal antennas are provided at as high positions as possible inside a device case, i.e., at upper portions of the device case in order to improve receiving sensitivities of the antennas.

However, because the notebook-sized PC disclosed by JP-A-2003-37538 has an antenna provided within a device case, the case may block radio waves electromagnetically. In this case, it is necessary to shift the location of the device in order to increase the sensitivities to radio waves.

To solve the problem, there has been proposed a structure such that a coaxial connector with a switching function is provided on the device case to connect an external antenna to the coaxial connector. According to this proposal, connecting the internal and external antennas selectively to a radio unit enables the sending and receiving of radio waves through the antenna with a better sensitivity.

Here, it is common that the external antenna and the coaxial connector, to which the external antenna is connected, are designed so as to have an impedance of 50 ohms for the purpose of the impedance matching between them.

However, their impedances cannot be always set to 50 ohms easily because the coaxial connector is restricted in shape. Further, setting the impedances to 50 ohms cannot necessarily reduce the transmission loss according to the frequency characteristics, which can make it difficult to pick out a required frequency effectively.

In the meanwhile, the radio communication system which is applied to wireless LANs, etc. is changing rapidly. For example, a 2.4 GHz frequency band is standardized under IEEE 802.11; a frequency band around 5.2 GHz is standardized under IEEE 802.11a. In addition, a 2.4 GHz frequency band is standardized under IEEE 802.11b; and a 2.4 GHz frequency band is standardized under IEEE 802.11g. Also, it is desired to standardize a frequency band around 5.8 GHz in the future.

Of these frequency bands, in case of a high frequency band of the order of 5 GHz, the internal antenna and radio unit may not be matched in impedance even when the external antenna and radio unit can be matched in impedance. Therefore, there is needed an impedance matching circuit for making the internal antenna and radio unit match in impedance.

However, the impedance matching circuit is a high frequency circuit, which is provided separately from a radio unit to be mounted inside the device case and a control unit for processing data. On this account, wireless communication device manufacturers have to design the impedance matching circuit whenever the applied frequency band is changed, which is inconvenient.

In order to solve the problems, it is an object of the present invention to provide a connector unit, which is used for an apparatus for switching internal and external antennas and is capable of matching the external and internal antennas in impedance.

To achieve the object, a novel connector unit as below is invented.

SUMMARY OF THE INVENTION (1) A connector unit for a high frequency radio apparatus having a housing, a first internal antenna provided inside the housing, a radio unit provided inside the housing for processing a radio signal, and an external antenna capable of being inserted and drawn from outside the housing, comprising: a printed board including a first microstrip line connected to said radio unit and a second microstrip line connected to said first internal antenna; a fixed contact provided on said printed board and connected to said second microstrip line; an elastically-deformable, movable contact provided on said printed board and connected to said first microstrip line, and urged toward said fixed contact; and a socket for covering said movable contact and said fixed contact, wherein a distal end of said external antenna enters between said movable contact and fixed contact when said external antenna is inserted into said socket, the distal end of said external antenna abuts on said movable contact and presses said movable contact to separate the movable contact from said fixed contact, and said external antenna is matched in impedance and connected to said radio unit, and wherein said movable contact abuts on said fixed contact when said external antenna is drawn from said socket, and said first internal antenna is matched in impedance and connected to said radio unit.

The first internal antenna may be one antenna, or one of two antennas in which the diversity system is adopted. It is preferable that the first internal antenna is compact when it is mounted in a portable electronic device. Therefore, the first internal antenna may be an inverted F antenna which utilizes the resonance of a metal plate constituting a top board of the device. The radio wave may have a frequency at or over 300 MHz, in UHF band or a higher band.

The housing means a case for a portable electronic device, e.g., a notebook-sized PC or PDA, and it may include a display portion.

The external antenna may be a wire antenna or a whip antenna. A coaxial cable may be connected to the external antenna and have a plug at a distal end of the coaxial cable.

The movable contact may be a leaf spring. The movable contact may be electrically connected to the fixed contact with a certain contact pressure.

The movable contact may be fixed to the microstrip line on the printed board by solder. Likewise, the fixed contact may be fixed to the microstrip line on the printed board by solder.

The printed board has a substrate of a dielectric and microstrip lines and ground pattern formed on the substrate, i.e., signal transmission lines. The characteristic impedance of the transmission lines may be determined by the relative permittivity and thickness of the printed board substrate, and the thickness, width, etc. of the microstrip line. In regard to the printed board, a glass-epoxy substrate having a relative permittivity of about 4.8 may be used for a high frequency circuit intended for UHF band to SHF band.

The socket may be fixed on the printed board by fastening means, such as screws. Also, the socket may be fixed on the printed board by attaching a fixed contact and movable contact to the socket and fixing the fixed and movable contacts on the printed board by solder, etc.

The first microstrip line and the radio unit may be coupled through a coaxial cable. Also, the second microstrip line and the first internal antenna may be coupled through a coaxial cable.

According to the present invention of (1), the external antenna and the first internal antenna can be switched only by inserting or drawing the plug with respect to the connector unit and as such, an antenna switching mechanism can be realized with a simple configuration.

Further, since the impedance matching circuit with the microstrip line is interposed between the first internal antenna, external antenna and the radio unit, the impedance matching can be performed even when the first internal antenna and the external antenna are not necessarily 50 ohms. Thus, the first internal antenna and the external antenna can be used in an optimum condition. Accordingly, the structural designing flexibility of the connector unit can be expanded, and thus it becomes possible to handle, for example, a 5 GHz frequency band.

(2) The connector unit according to (1), wherein said external antenna has a plug provided at the distal end thereof, said plug including a pin-shaped signal contact and a cylindrical ground contact surrounding the signal contact, said socket has a grounded cylindrical first shell for covering said movable contact and fixed contact and a grounded cylindrical second shell for covering the first shell, and wherein said signal contact enters inside said first shell and separates said movable contact from said fixed contact when said plug is inserted into said socket, and said ground contact enters between said first shell and second shell and abuts on both of said first shell and second shell.

According to the present invention of (2), the ground line can be grounded reliably, because the plug is inserted into the connector unit thereby to cause the outer and inner surfaces of the ground contact to abut on both the first shell and second shell.

(3) The connector unit according to (1) or (2), wherein said printed board has a ground pattern, and a circuit element mounting area formed between the ground pattern and said second microstrip line and having a circuit element mounted thereon.

The microstrip lines may be formed on one surface of the printed board and covered with the socket, and the ground pattern may be formed on the other surface of the printed board. Otherwise, the microstrip lines and the ground pattern may be formed on one surface of the printed board. In this case, a certain distance may be provided between the microstrip lines and the ground pattern so as to avoid the influence on the characteristic impedance.

The circuit element is preferably a leadless chip component, such as a chip capacitor and a chip inductor, according to the high frequency circuit.

The forms of the microstrip lines and ground pattern depend on the frequency band of the associated radio waves. On this account, the form of the circuit element mounting area also depends on the frequency band of the associated radio waves.

Therefore, according to the present invention of (3), the mounting area for circuit elements is secured when a pattern is designed. Thus, the circuit element mounting area will be previously provided and as such, the number of steps for the designing is not needed so much and manufacturing costs of connector units can be reduced. In addition, the formation of an open stub and a short stub on the microstrip line can further reduce manufacturing costs of connector units.

Moreover, no circuit element may be actually mounted in the mounting area of the circuit element.

(4) The connector unit according to (3), wherein said circuit element is a chip capacitor which allows a signal under a cutoff frequency of said first internal antenna to pass therethrough directly and attenuates a signal at or over the cutoff frequency of said first internal antenna.

(5) The connector unit according to (3), wherein said circuit element is a chip inductor which allows a signal over a cutoff frequency of said first internal antenna to pass therethrough directly, and attenuates a signal at or under the cutoff frequency of said first internal antenna.

(6) The connector unit according to (1) or (2), wherein said printed board includes a chip capacitor connected in series to said second microstrip line, and the chip capacitor allows a signal under a cutoff frequency of said first internal antenna to pass therethrough directly, and attenuates a signal at or over the cutoff frequency of said first internal antenna.

(7) The connector unit according to (1) or (2), wherein said printed board includes a chip inductor connected in series to second microstrip line, and the chip inductor allows a signal over a cutoff frequency of said first internal antenna to pass therethrough directly, and attenuates a signal at or under the cutoff frequency of said first internal antenna.

According to the present inventions of (4) and (6), for example, a lowpass filter is added to the impedance matching circuit, thereby allowing only a signal (radio wave) having a frequency under a cutoff frequency required for the first internal antenna to pass through the filter and attenuating an unwanted signal (radio wave) at or over the cutoff frequency.

Thus, the gain of a signal (radio wave) at or over the cutoff frequency is reduced into no response. Therefore, a definite multiple frequency wave having an unwanted high frequency component can be easily removed.

According to the present inventions of (5) and (7), for example, a highpass filter is only added to the impedance matching circuit, thereby allowing only a signal (radio wave) having a frequency over a cutoff frequency required for the first internal antenna to pass through the filter and attenuating an unwanted signal (radio wave) at or under the cutoff frequency.

Thus, the gain of a signal (radio wave) at or under the cutoff frequency is decreased into no response. Therefore, a definite multiple frequency wave having an unwanted low frequency component can be easily removed.

(8) The connector unit according to any one of (1) to (7), wherein said first internal antenna and said external antenna send and receive any one of a radio wave of a 2.4 GHz frequency band standardized under IEEE 802.11, a radio wave of a frequency band around 5.2 GHz standardized under IEEE 802.11a, a radio wave of a 2.4 GHz frequency band standardized under IEEE 802.11b, and a radio wave of a 2.4 GHz frequency band standardized under IEEE 802.11g.

According to the present invention of (8), it becomes possible to conform to Bluetooth as well as a standard for a frequency band about 5.8 GHz in the wireless LAN.

(9) The connector unit according to (8), further having a second internal antenna provided inside said housing and connected to said radio unit, wherein a diversity system is adopted.

DETAILED DESCRIPTION OF THE PREFERRED EMBODIMENT

An embodiment of the present invention will be described below in reference to the drawings.

Figure 1:
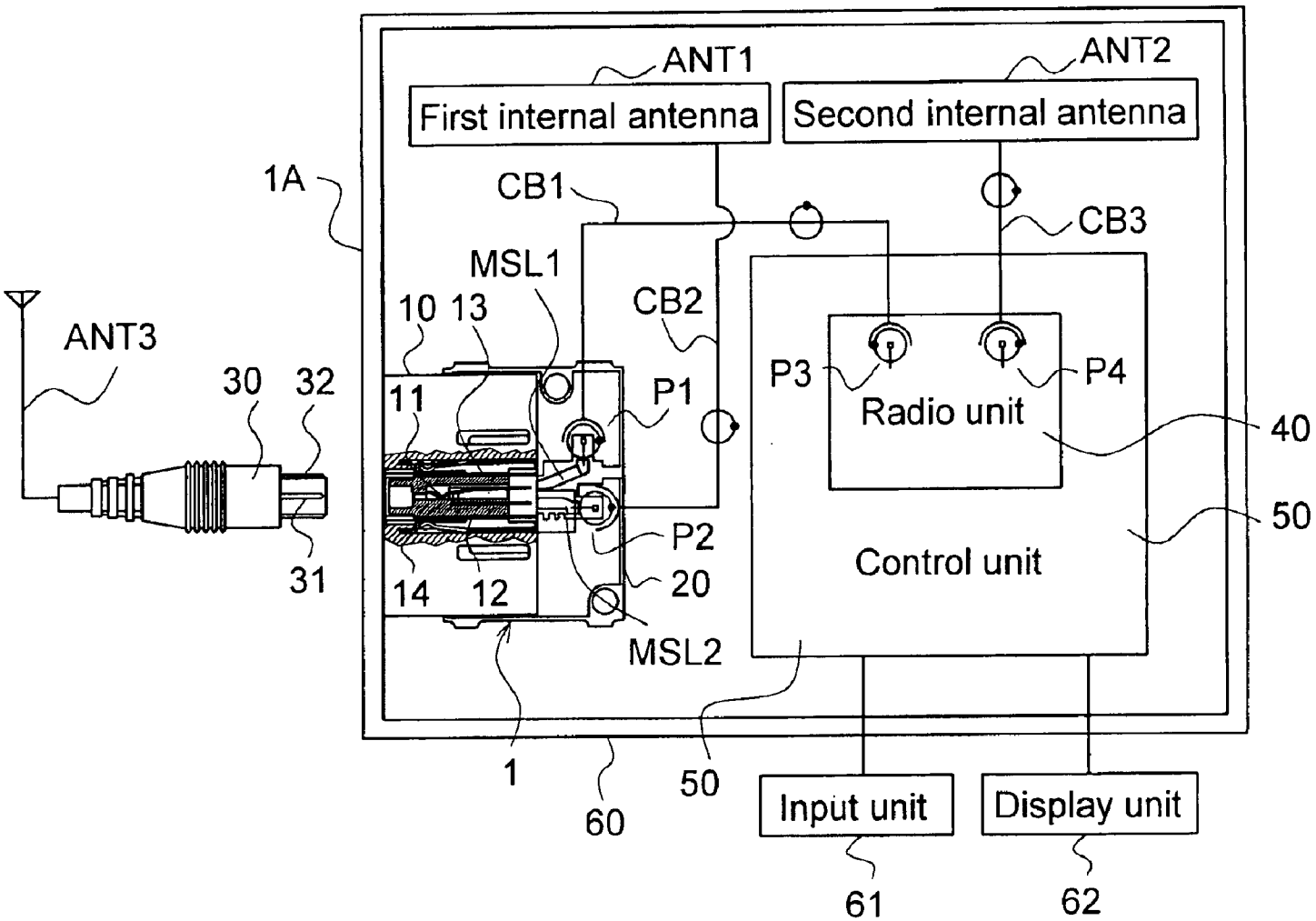
FIG. 1 is a plan view showing a schematic configuration of a notebook-sized PC as a high frequency radio apparatus to which a connector unit according to an embodiment of the present invention is applied.

FIG. 1 is a plan view showing a schematic configuration of a notebook-sized PC as a high frequency radio apparatus, to which a connector, as a connector unit according to an embodiment of the present invention, is applied.

The notebook-sized PC includes a main body 60, an input unit 61 and display unit 62, both provided on the main body 60, and an external antenna ANT3 capable of being connected and disconnected to the main body 60.

For example, the input unit 61 has a keyboard or a mouse, and outputs an operation signal to the control unit 50 of the main body 60, which is to be described later.

The display unit 62 is, for example, a display, and displays the image information output from the later-described control unit 50 of the main body 60.

The main body 60 has a housing 1A, internal antennas ANT1, ANT2 provided inside the housing 1A, a connector 1, a radio unit 40, and a control unit 50.

The control unit 50 has a main board, for example, including a CPU, and a memory, and it controls the radio unit 40, input unit 61, and display unit 62 thereby to process data. moreover, the radio unit 40 may be provided integrally on the main board of the control unit 50.

The connector 1 serves to selectively connect the first internal antenna ANT1 or external antenna ANT3 to the radio unit 40 and it has a first port P1 and a second port P2 as connection terminals. The first port P1 is connected through a coaxial cable CB1 to a third port P3 of the radio unit 40. The second port P2 is connected through a coaxial cable CB2 to the first internal antenna ANT1.

In regard to the connector 1, when the external antenna ANT3 is connected to the connector 1 of the main body 60, the external antenna ANT3 is connected to the first port P1. In contrast, when the external antenna ANT3 is not connected to the connector 1 of the main body 60, the second port P2 is connected to the first port P1 and thus the first internal antenna ANT1 is connected to the first port.

The diversity system is adopted for the antennas ANT1-3; the first internal antenna ANT1 and external antenna ANT3 are antennas for sending and receiving (main antennas), and the second internal antenna ANT2 is an antenna only for receiving (sub-antenna).

The diversity system uses the main antenna in sending data, whereas in receiving data it selectively uses one of main antenna and sub-antenna, which has a higher receiving level. This can minimize the variation of received radio wave levels to the utmost. In this embodiment, the first internal antenna ANT1 and external antenna ANT3 are used as main antennas and the second internal antenna ANT2 is used as a sub-antenna. However, the present invention is not so limited, the antennas may be reversed.

Figure 2:
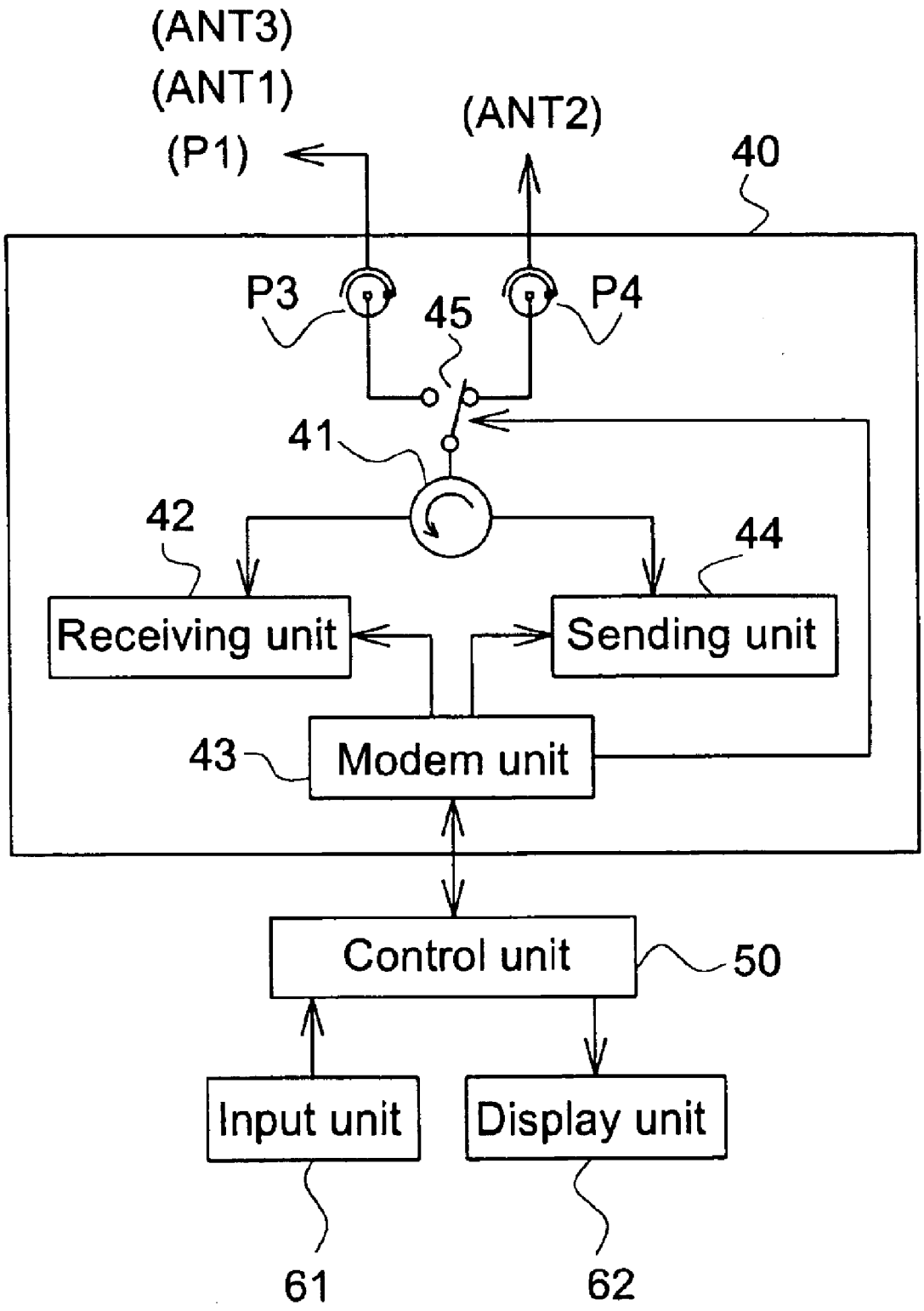
FIG. 2 is a diagrammatic view showing a schematic configuration of a radio unit according to the embodiment.

FIG. 2 is a diagrammatic view showing a schematic configuration of the radio unit 40.

The radio unit 40 sends or receives and processes radio signal, and it has a third port P3 and fourth port P4 as connection terminals. The third port P3 is connected through the coaxial cable CB2 to the first port P1 of the connector 1, which is to be described later, and the fourth port P4 is connected through the coaxial cable CB3 to the second internal antenna ANT2.

The radio unit 40 includes a circulator 41, a receiving unit 42, a modem unit 43, a sending unit 44, and antenna switch 45.

The sending unit 44 outputs a radio signal for sending.

The receiving unit 42 converts a received radio signal into a signal with predetermined frequency and level, and then amplifies the resultant signal into a received signal.

The third port P3 or fourth port P4 is selected with the antenna switch 45. More specifically, when the third port P3 is selected, radio signals from the first internal antenna ANT1 and external antenna ANT3 are output to the receiving unit 42. When the fourth port P4 is selected, radio signals from the second internal antenna ANT2 are output to the receiving unit 42.

The circulator 41 outputs sending radio signals from the sending unit 44 to the antenna switch 45, and outputs receiving radio signals from the antenna switch 45 to the receiving unit 42. Also, the circulator 41 has the function of an isolator to prevent radio signals received at the antennas ANT1-3 or radio signals to be sent from the antennas ANT1, 3 from being affected from the receiving unit 42 or sending unit 44.

The modem unit 43 modulates digital signals from the control unit 50 to output them to the sending unit 44, and demodulates received signals from the receiving unit 42 to output digital signals, i.e., demodulated data, to the control unit 50.

Also, the modem unit 43 controls the radio unit 40. More specifically, it selects the frequency of transmitted signals and received signals, controls the level of a radio signal which the sending unit 44 outputs, and switches the antenna switch 45, etc.

The operation of the radio unit 40 in receiving radio signals is as follows. First, radio signals received with the antennas ANT1-3 are passed through the circulator 41 and amplified in the receiving unit 42. The amplified radio signals are demodulated into digital signals by the modem unit 43 to be output to the control unit 50.

A notebook-sized PC adopts the diversity system as described above and as such, at the time of starting to receive radio signals, it compares radio signals from the second internal antenna ANT2 in level with those of the first internal antenna ANT1 (or external antenna ANT3), and switches the antenna switch 45 thereby to connect the antenna having a higher radio signal level to the receiving unit 42.

In contrast, the operation of the radio unit 40 in sending radio signals is as follows. First, when digital signals are output from the control unit 50, the digital signals are modulated into radio signals in the modem unit 43 and then amplified in the sending unit 44. The radio signals are passed through the circulator 41 and radiated from the antennas ANT1, 3.

Now, the structure of the connector 1 will be described in reference to FIGS. 3A–3B, and 4A–4D.

Figure 3B:
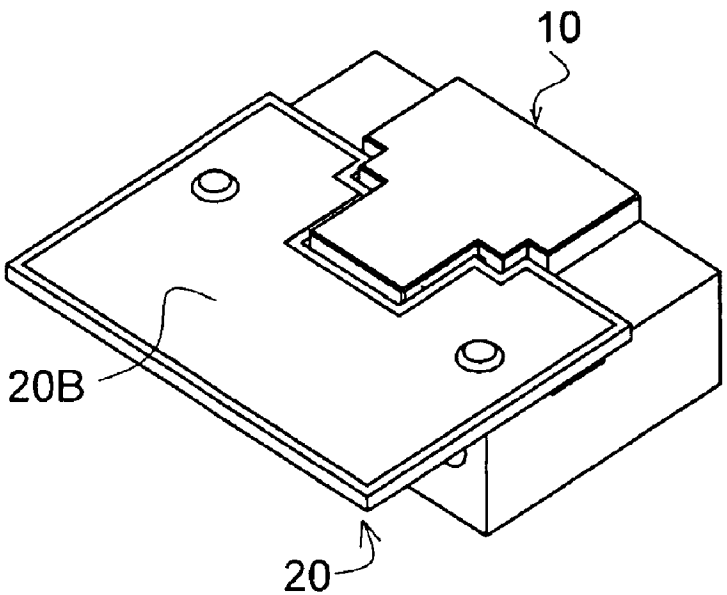
FIG. 3B is a perspective view showing the inverted connector unit according to the embodiment.
Figure 3A:
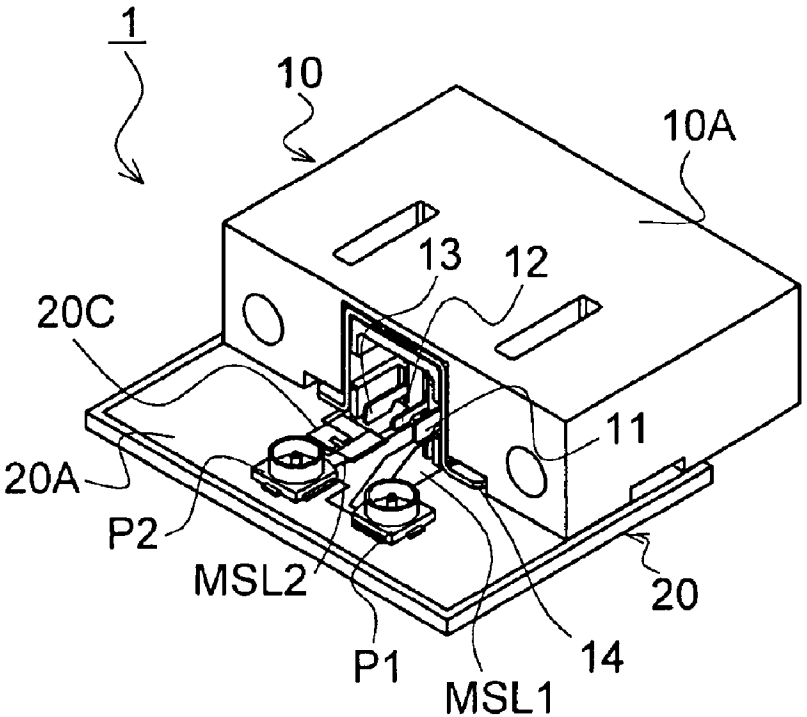
FIG. 3A is a perspective view of the connector unit according to the embodiment.

FIG. 3A is a perspective view of the connector 1, and FIG. 3B is a perspective view of the connector 1 viewed from the rear face.

Figure 4A:
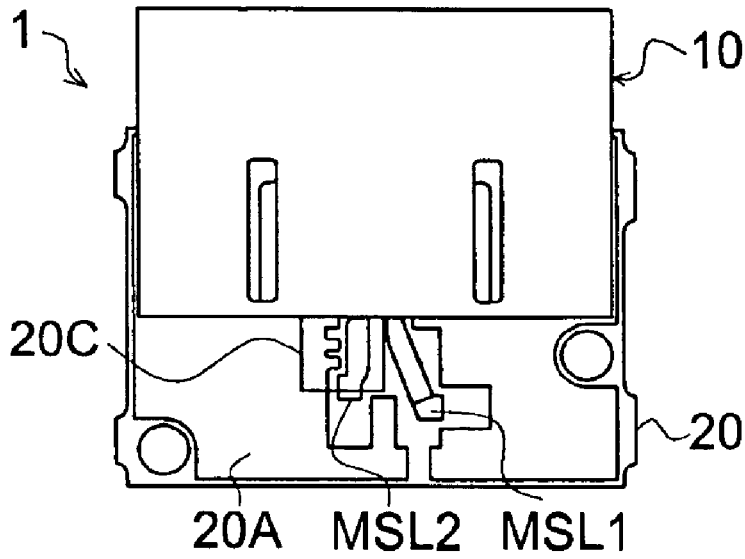
FIG. 4A is a plan view of the connector unit according to the embodiment.
Figure 4B:
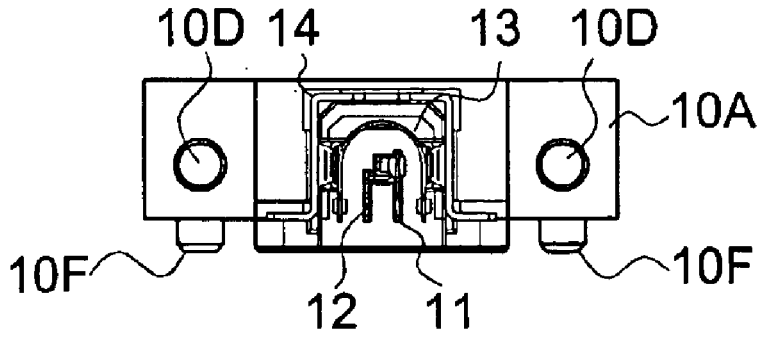
FIG. 4B is a front view of the connector unit according to the embodiment.
Figure 4C:
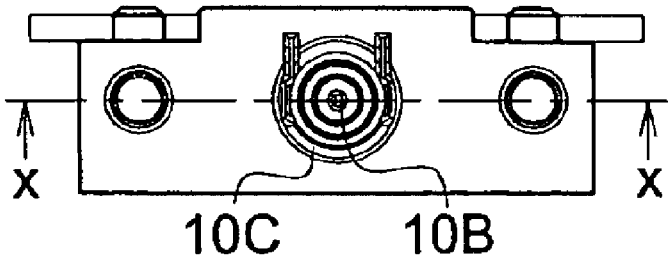
FIG. 4C is a rear view of the connector unit according to the embodiment.
Figure 4D:
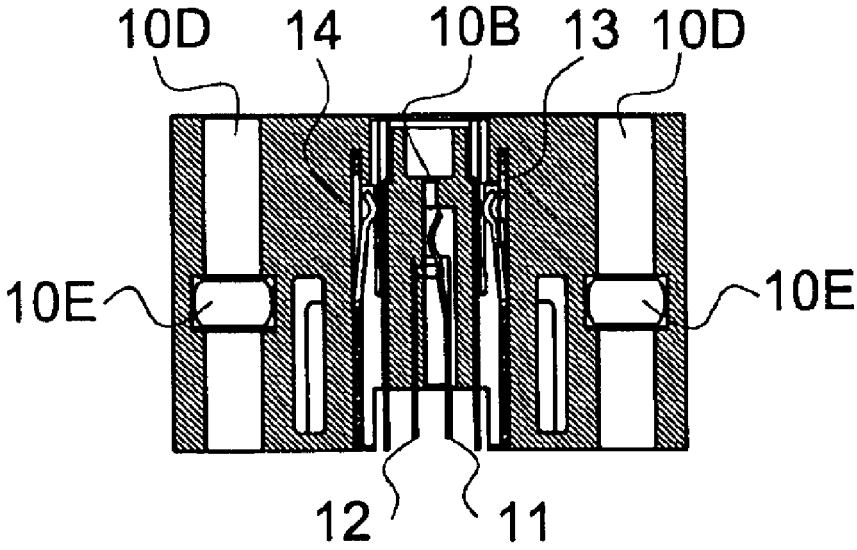
FIG. 4D is a cross-sectional view along the line X—X in FIG. 4C.

FIG. 4A is a plan view of the connector 1, FIG. 4B is a front view of the connector 1, FIG. 4C is a rear view of the connector 1, and FIG. 4D is a cross-sectional view along the line X—X in FIG. 4C. Moreover, in FIG. 4A the first port P1 and second port P2 are omitted for the purpose of making clear the pattern layout of a ground pattern 20A.

Figure 5:
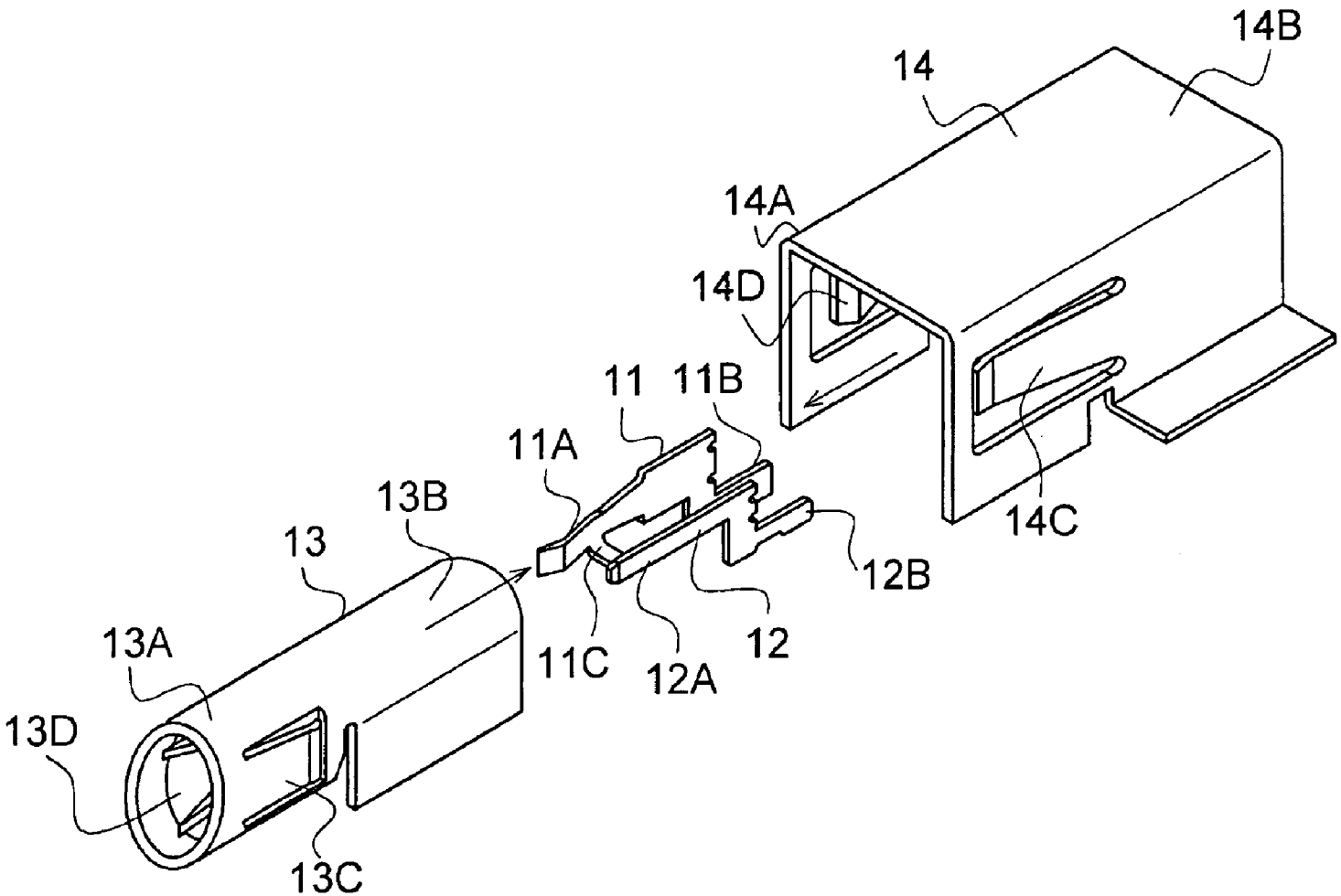
FIG. 5 is an exploded perspective view of a part of the connector unit according to the embodiment.
Figure 6:
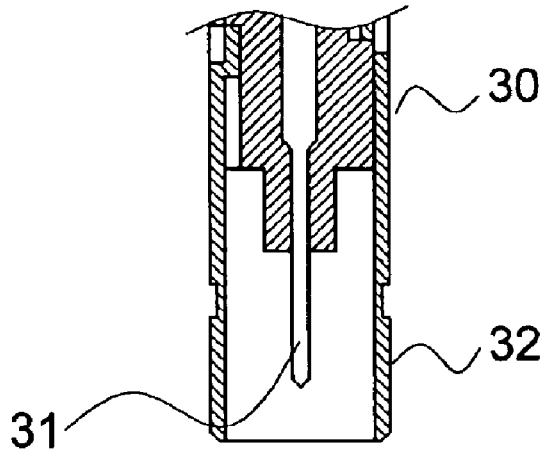
FIG. 6 is an enlarged cross-sectional view of the connector unit according to the embodiment.
Figure 6:
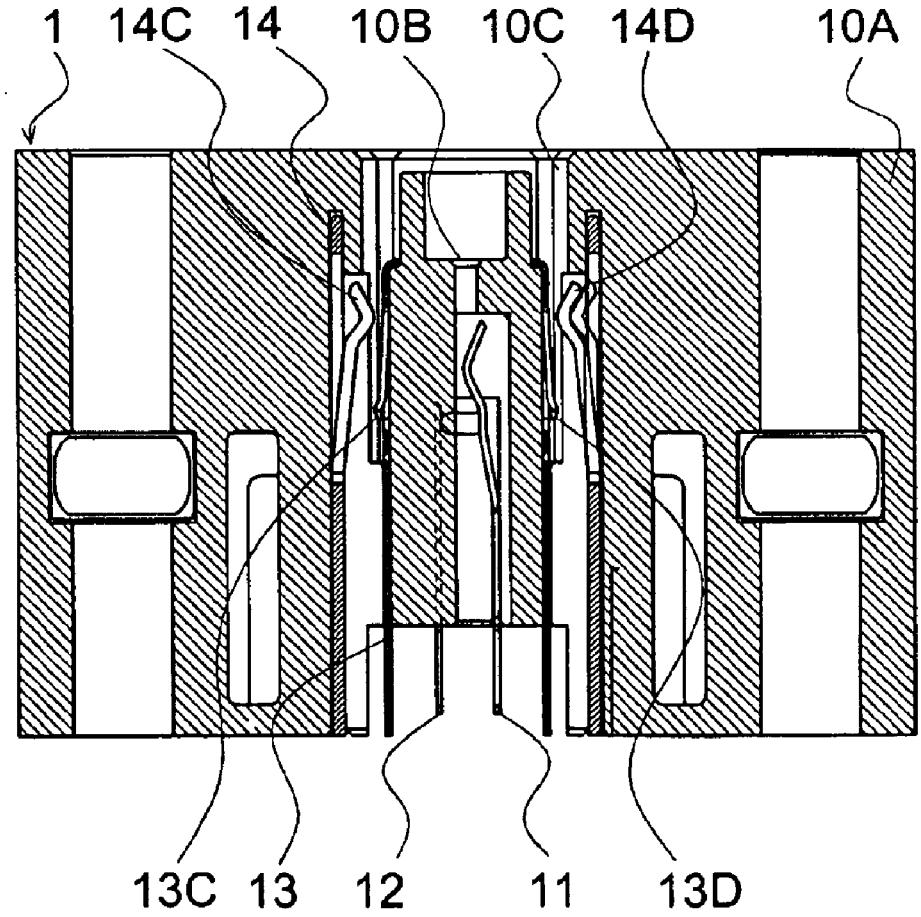

FIG. 5 is an exploded perspective view of a part of the connector 1, and FIG. 6 is an enlarged cross-sectional view of the connector 1.

The connector 1 is provided so that it is partially exposed from a side face of the housing 1A (see FIG. 1). The connector 1 includes a printed board 20, a fixed contact 12 and movable contact 11, both provided on the printed board 20, and a socket 10 for covering the contacts 11, 12.

The external antenna ANT3 can be inserted into and drawn from the connector 1 exposed from the side face of the housing 1A. On the distal end of the external antenna ANT3, a plug 30 is attached as shown in FIG. 1. The plug 30 includes a pin-shaped signal contact 31 connected to the external antenna ANT3 and a cylindrical ground contact 32 surrounding the signal contact 31.

The fixed contact 12 is provided on the printed board 20 and connected to the other end of a second microstrip line.

The fixed contact 12 is tabular and has a proximal end portion 12B fixed on the other end of the second microstrip line MSL2 by solder, etc., and a distal end portion 12A on which a bending piece 11C of the movable contact to be described later abuts.

The movable contact 11 is provided on the printed board 20 and connected to the other end of a first microstrip line. The movable contact 11 is urged toward the fixed contact 12.

The movable contact 11 is formed from a leaf spring and includes a proximal end portion 11B fixed on the other end of the first microstrip line MSL1 by solder, etc., and a distal end portion 11A which becomes closer to the fixed contact 12 as it extends forward.

The distal end portion 11A is placed in a pathway through which the signal contact 31 runs. The curvature of the distal end portion 11A may be set appropriately.

The tip of the distal end portion 11A is bent toward the fixed contact 12 thereby to form the bending piece 11C abutting on the fixed contact 12.

Thus, the fixed contact 12 is connected to the first internal antenna ANT1 through the second microstrip line MSL2, second port P2, and coaxial cable CB2.

In contrast, the movable contact 11 is connected to the radio unit 40 through the first microstrip line MSL1, first port P1, and coaxial cable CB1.

The printed board 20 is disposed on the bottom face of the socket 10. As shown in FIG. 3A, the first microstrip line MSL1, second microstrip line MSL2, and ground pattern 20A are formed on the top face of the printed board 20.

The ground pattern 20A is formed some distance away from the microstrip lines MSL1, MSL2 to avoid the influence on the characteristic impedance.

Between the second microstrip line MSL2 and ground pattern 20A, there is provided a circuit element mounting area 20C, in which circuit elements including a chip capacitor and a chip inductor are mounted.

More specifically, two lands on which two circuit elements are mounted are provided in the circuit element mounting area 20C.

In addition, a ground pattern 20B is formed on the bottom face of the printed board 20, as shown in FIG. 3B.

The first port P1 is a coaxial connector (coaxial socket) provided on one end side of the first microstrip line MSL1, and the second port P2 is a coaxial connector (coaxial socket) provided on one end side of the second microstrip line MSL2.

The conductors of the first port P1 and second port P2 are connected to the one ends of the first microstrip line MSL1 and second microstrip line MSL2. Further, the ground contacts of the first port P1 and second port P2 are connected to the ground pattern 20A to be grounded.

The socket 10 is generally of a box shape, and fixed on the inside wall surface of the housing 1A. The socket 10 includes a first shell 13 for covering the movable contact 11 and fixed contact 12, a second shell 14 for covering the first shell 13, and an insulative socket housing 10A for covering the shells 13, 14.

In the socket housing 10A, there is formed a through-hole 10G extending from the side face thereof adjacent to the housing 1A in an axial direction. The above-described movable contact 11, fixed contact 12, first shell 13, and second shell 14 are housed in the through-hole 10G and partially exposed from the rear end side of the through-hole 10G.

Also, the socket housing 10A has two through-holes 10D formed on the both sides of the through-hole 10G. In each through-hole 10D, a nut 10E is press-fit, as shown in FIG. 4D. By putting an external screw into the nut 10E from outside the housing 1A to screw through the nut 10E of the connector 1, the connector 1 can be attached on a side wall of the housing 1A, as shown in FIG. 1.

The socket housing 10A has two raised portions 10F formed on the bottom face thereof. The printed board 20 has positioning holes (not shown) formed therein, and therefore putting the raised portions 10F of the socket housing 10A into the positioning holes allows the positioning of the socket 10 with respect to the printed board 20.

The first shell 13 is conductive and has a cylindrical distal end and a proximal end which is U-shaped in cross section. On the side of the distal end of the first shell 13, there is a pair of first contact pieces 13C, 13D, which are disposed opposite each other. The first contact pieces 13C, 13D are elastically deformable and extend outwardly of the first shell 13. The side of the proximal end of the first shell 13 is fixed on the ground pattern 20A (shown in FIG. 3) by solder, etc. and grounded.

The second shell 14 is conductive and has a cylindrical distal end and a proximal end which is U-shaped in cross section. On the side of the distal end of the second shell 14, there is a pair of second contact pieces 14C, 14D, which are disposed opposite each other. The second contact pieces 14C, 14D are elastically deformable and extend inwardly of the second shell 14. On the side of the proximal end of the second shell 14, a flange (brim) is formed. The flange is fixed on the ground pattern 20A (shown in FIG. 3) by solder, etc. and grounded.

The movable contact 11, fixed contact 12, first shell 13, and second shell 14 are press-fit in the socket housing 10A and integrated, as shown in FIG. 6. The movable contact 11 and fixed contact 12 are press-fit into the first shell 13 from the proximal end side; the first shell 13 is press-fit into the second shell 14 from the distal end side.

Inside the first shell 13, there is formed a first through-hole 10B in which the signal contact 31 of the plug 30 is inserted. Between the first shell 13 and second shell 14, there is formed a second through-hole 10C in which the ground contact 32 of the plug 30 is inserted. The first through-hole 10B and second through-hole 10C make concentric circles.

When the plug 30 is inserted in the connector 1, the ground contact 32 of the plug 30 is inserted in the second through-hole 10C of the connector 1. Then, the inner surface of the ground contact 32 contacts the first contact pieces 13C, 13D of the first shell 13, and the outer surface of the ground contact 32 contacts the second contact pieces 14C, 14D of the second shell 14. The ground contact 32 is thus connected to the connector 1 reliably.

Further, when the plug 30 is inserted in the connector 1, the signal contact 31 of the plug 30 is inserted in the first through-hole 10B. Then, the signal contact 31 presses the distal end portion 11A of the movable contact 11 lying on its pathway outwardly. Thus, the distal end portion 11A of the movable contact 11 is elastically deformed, and the bending piece 11C is separated from the distal end portion 12A of the fixed contact 12. As a result, the movable contact 11 is electrically insulated from the fixed contact 12.

When the plug 30 is removed from the connector 1, the distal end portion 11A of the movable contact 11 is returned to its original position and then the bending piece 11C electrically contacts the distal end portion 12A of the fixed contact 12 again.

With the connector 1 as described above, in the condition where the external antenna ANT3 is inserted in the socket 10, the signal contact 31 of the plug 30 is entered between the movable contact 11 and fixed contact 12. Accordingly, the signal contact 31 abuts on the movable contact 11 and presses the movable contact 11 to separate it from the fixed contact 12. In other words, the movable contact 11 is elastically deformed and disconnected from the fixed contact 12. As a result, the external antenna ANT3 is connected to the radio unit 40.

At this time, the external antenna ANT3 is matched in impedance with the first microstrip line MSL1 and first port P1.

In contrast, in the condition where the external antenna ANT3 is not inserted in the socket 10, the external antenna ANT3 is drawn from the socket 10, the movable contact 11 abuts on the fixed contact 12. As a result, the first internal antenna ANT1 is connected to the radio unit 40.

At this time, the first internal antenna ANT1 is matched in impedance with the second port P2, second microstrip line MSL2, fixed contact 12, movable contact 11, first microstrip line MSL1, and first port P1.

Next, an example of the impedance matching circuit according to the connector 1 of the present invention will be described in reference to FIGS. 7A–E.

In FIGS. 7A–E, two connection terminals of the second microstrip line MSL2 are connected to the fixed contact 12 and the second port P2.

Figure 7A:
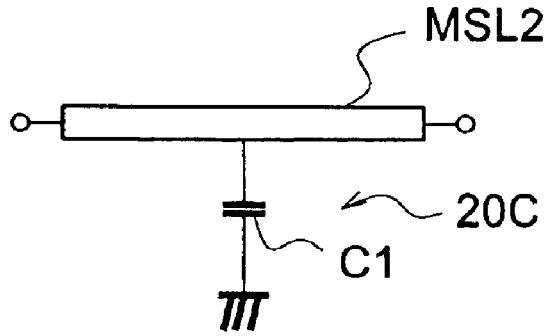
FIG. 7A is a circuit diagram of the impedance matching circuit according to the first example.

For example, as shown in FIG. 7A, a chip capacitor C1 may be connected between the second microstrip line MSL2 and ground pattern 20B.

More specifically, the chip capacitor allows a signal (radio wave) having a frequency under a cutoff frequency required for the first internal antenna ANT1 to pass therethrough directly and attenuates an unwanted signal (radio wave) at or over the cutoff frequency.

The chip capacitor C1 is provided in the circuit element mounting area 20C. One of the connection terminals of the chip capacitor C1 is connected to the second microstrip line MSL2, and the other connection terminal is connected to the ground pattern 20A.

Figure 7B:
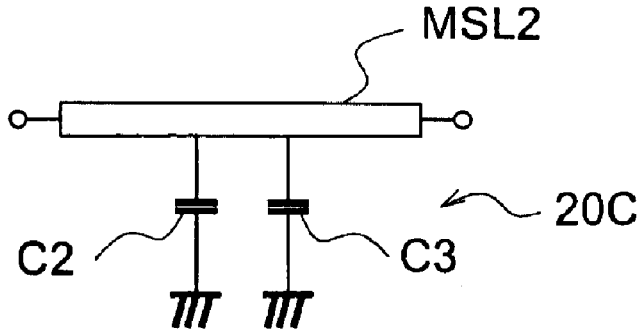
FIG. 7B is a circuit diagram of an impedance matching circuit according to the second example.

In addition, as shown in FIG. 7B, chip capacitors C2, C3 may be connected in parallel between the second microstrip line MSL2 and ground pattern 20A.

Figure 8:
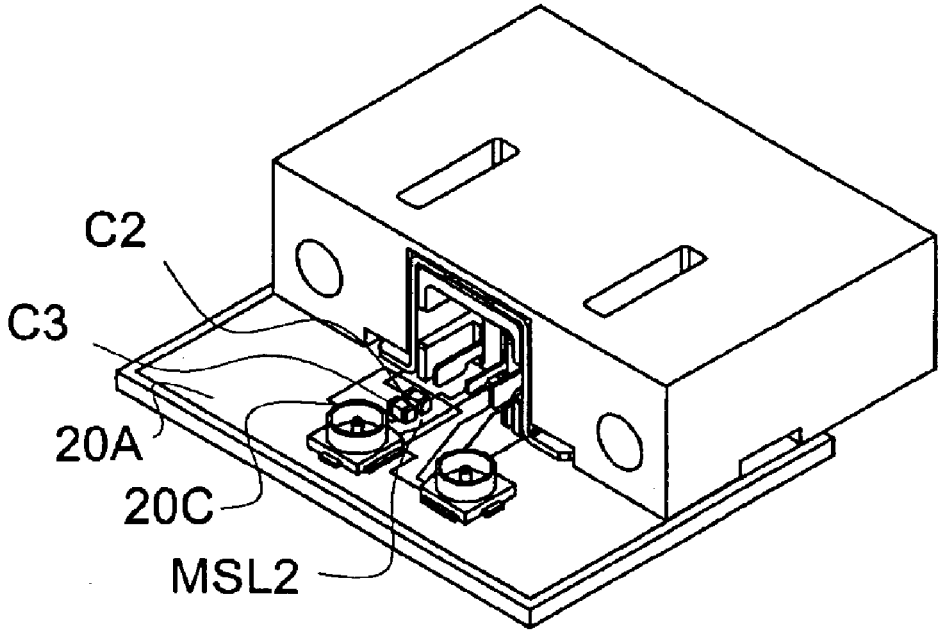
FIG. 8 is a perspective view of a connector unit to which the impedance matching circuit according to the second example is applied.

More specifically, as shown in FIG. 8, the two chip capacitors C2, C3 are provided in the circuit element mounting area 20C. The one connection terminals of the two chip capacitors C2, C3 are connected to the second microstrip line MSL2, and the other connection terminals are connected to the ground pattern 20A.

Figure 7C:
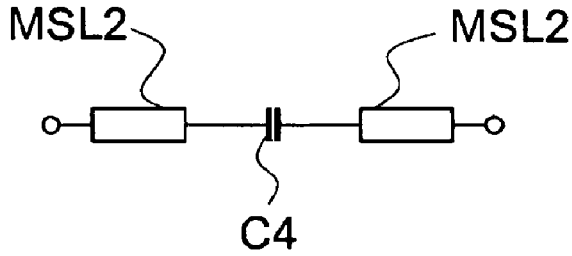
FIG. 7C is a circuit diagram of an impedance matching circuit according to the third example.

Further, as shown in FIG. 7C, a chip capacitor C4 may be connected in series in the second microstrip line MSL2.

A lowpass filter is thus provided in the impedance matching circuit and as such, the gain of a signal (radio wave) at or over the cutoff frequency is decreased into no response. Therefore, a definite multiple frequency wave having an unwanted high frequency component can be easily removed.

Figure 7D:
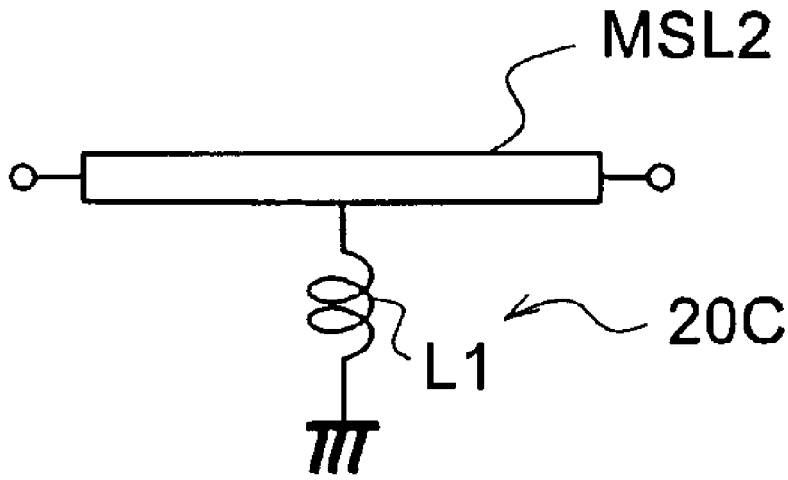
FIG. 7D is a circuit diagram of an impedance matching circuit according to the fourth example.

Further, as shown in FIG. 7D, a chip inductor L1 may be connected between the second microstrip line MSL2 and ground pattern 20A.

More specifically, the chip inductor allows a signal (radio wave) having a frequency over a cutoff frequency required for the first internal antenna ANT1 to pass therethrough directly and attenuates an unwanted signal (radio wave) at or under the cutoff frequency.

Figure 9:
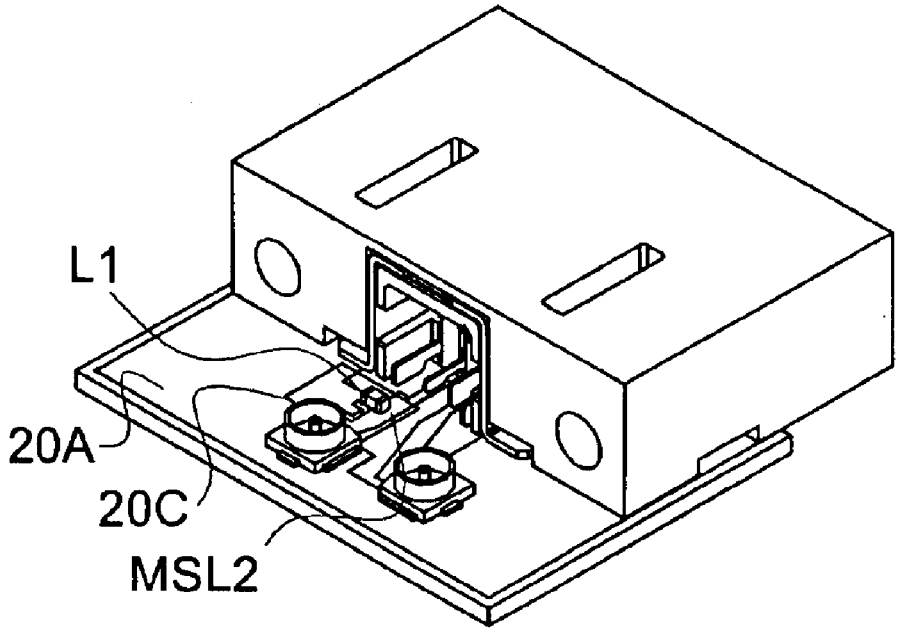
FIG. 9 is a perspective view of a connector unit to which the impedance matching circuit according to the fourth example is applied.

The chip inductor L1 is provided in the circuit element mounting area 20C, as shown in FIG. 9. One of the connection terminals of the chip inductor L1 is connected to the second microstrip line MSL2, and the other connection terminal is connected to the ground pattern 20A.

Figure 7E:
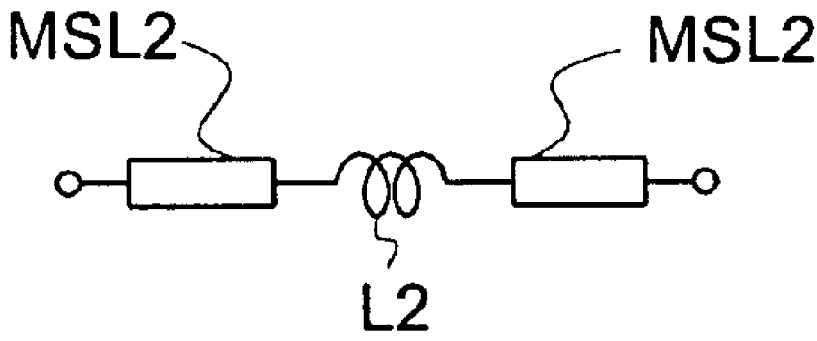
FIG. 7E is a circuit diagram of an impedance matching circuit according to the fifth example.

In addition, as shown in FIG. 7E, a chip inductor L2 may be connected in series in the second microstrip line MSL2.

A highpass filter is thus provided in the impedance matching circuit and as such, the gain of a signal (radio wave) at or under the cutoff frequency is decreased into no response. Therefore, a definite multiple frequency wave having an unwanted low frequency component can be easily removed.

The invention is not limited to the above embodiment, and any modifications and improvements may be included in the present invention within a scope such that the object of the present invention can be achieved.

While the connector unit is applied to a notebook-sized PC in the embodiment, it is not so limited and applicable to PDAs or other electronic devices.

In the above connector, by designing the strip line circuit appropriately, it is possible to send and receive any one of a radio wave of 2.4 GHz frequency band standardized under IEEE 802.11, a radio wave of the 5.2 GHz peripheral frequency band standardized under IEEE 802.11a, a radio wave of 2.4 GHz frequency band standardized under IEEE 802.11b, and a radio wave of 2.4 GHz frequency band standardized under IEEE 802.11g, using the first internal antenna and external antenna.

According to the connector unit of the present invention, the following advantages can be obtained.

An antenna switching mechanism can be realized with a simple configuration, because the external antenna and first internal antenna can be switched only by inserting and drawing the plug with respect to the connector unit.

Since an impedance matching circuit based on microstrip lines are interposed between the first internal antenna and external antenna, the first internal antenna and external antenna can be matched in impedance even when they are not necessarily of 50 ohms, and the first internal antenna and external antenna can be used in an optimum condition. Therefore, the structural designing flexibility of the connector unit can be expanded, and thus it becomes possible to handle, for example, a 5 GHz frequency band.

What is claimed is:

1. A connector unit for a high frequency radio apparatus having a housing, a first internal antenna provided inside the housing, a radio unit provided inside the housing for processing a radio signal, and an external antenna capable of being inserted and drawn from outside the housing, comprising:

a printed board including a first microstrip line connected to said radio unit and a second microstrip line connected to said first internal antenna;

a fixed contact provided on said printed board and connected to said second microstrip line;

an elastically-deformable, movable contact provided on said printed board and connected to said first microstrip line, and urged toward said fixed contact; and a socket for covering said movable contact and said fixed contact, wherein a distal end of said external antenna enters between said movable contact and fixed contact when said external antenna is inserted into said socket, the distal end of said external antenna abuts on said movable contact and presses said movable contact to separate the movable contact from said fixed contact, and said external antenna is matched in impedance and connected to said radio unit, and wherein said movable contact abuts on said fixed contact when said external antenna is drawn from said socket, and said first internal antenna is matched in impedance and connected to said radio unit.

2. The connector unit of claim 1, wherein said external antenna has a plug provided at the distal end thereof, said plug including a pin-shaped signal contact and a cylindrical ground contact surrounding the signal contact, said socket has a grounded cylindrical first shell for covering said movable contact and fixed contact and a grounded cylindrical second shell for covering the first shell, and wherein said signal contact enters inside said first shell and separates said movable contact from said fixed contact when said plug is inserted into said socket, and said ground contact enters between said first shell and second shell and abuts on both of said first shell and second shell.

3. The connector unit of claim 1 or 2, wherein said printed board has a ground pattern, and a circuit element mounting area formed between the ground pattern and said second microstrip line and having a circuit element mounted thereon.

4. The connector unit of claim 3, wherein said circuit element is a chip capacitor which allows a signal under a cutoff frequency of said first internal antenna to pass therethrough directly and attenuates a signal at or over the cutoff frequency of said first internal antenna.

5. The connector unit of claim 3, wherein said circuit element is a chip inductor which allows a signal over a cutoff frequency of said first internal antenna to pass therethrough directly, and attenuates a signal at or under the cutoff frequency of said first internal antenna.

6. The connector unit of claim 1 or 2, wherein said printed board includes a chip capacitor connected in series to said second microstrip line, and the chip capacitor allows a signal under a cutoff frequency of said first internal antenna to pass therethrough directly, and attenuates a signal at or over the cutoff frequency of said first internal antenna.

7. The connector unit of claim 1 or 2, wherein said printed board includes a chip inductor connected in series to second microstrip line, and the chip inductor allows a signal over a cutoff frequency of said first internal antenna to pass therethrough directly, and attenuates a signal at or under the cutoff frequency of said first internal antenna.

8. The connector unit of any one of claims 1 or 2, wherein said first internal antenna and said external antenna send and receive any one of a radio wave of a 2.4 GHz frequency band standardized under IEEE 802.11, a radio wave of a frequency band around 5.2 GHz standardized under IEEE 802.11a, a radio wave of a 2.4 GHz frequency band standardized under IEEE 802.11b, and a radio wave of a 2.4 GHz frequency band standardized under IEEE 802.11g.

9. The connector unit of claim 8, further comprising a second internal antenna provided inside said housing and connected to said radio unit, wherein a diversity system is adopted.

* * * * *